United States Patent [19]

Horwitz

[11] 4,204,371

[45] * May 27, 1980

[54] TOOL SHARPENING FIXTURE FOR A GRINDING TOOL

[76] Inventor: Norman H. Horwitz, 6608 Cottonwood Knoll, West Bloomfield, Mich. 48033

[ * ] Notice: The portion of the term of this patent subsequent to May 30, 1995, has been disclaimed.

[21] Appl. No.: 910,934

[22] Filed: May 30, 1978

Related U.S. Application Data

[63] Continuation-in-part of Ser. No. 806,821, Jun. 15, 1977, Pat. No. 4,091,574.

[51] Int. Cl.[2] ..... B24B 3/60; B24B 21/10

[52] U.S. Cl. ..... 51/141; 51/218 A

[58] Field of Search ..... 51/102, 135 R, 141, 51/216 R, 216 A, 218 R, 218 A, 220

[56] References Cited

U.S. PATENT DOCUMENTS

| | | | |
|---|---|---|---|
| 411,217 | 9/1889 | Dick | 51/220 |
| 981,810 | 1/1911 | Sterling | 51/218 A X |
| 1,206,791 | 12/1916 | Anderson | 51/220 |
| 2,352,690 | 7/1944 | Clausing | 51/141 |
| 4,091,574 | 5/1978 | Horwitz | 51/141 |

FOREIGN PATENT DOCUMENTS

| | | | |
|---|---|---|---|
| 1109294 | 1/1956 | France | 51/141 |
| 577941 | 6/1958 | Italy | 51/135 R |

*Primary Examiner*—Gary L. Smith
*Assistant Examiner*—Robert P. Olszewski
*Attorney, Agent, or Firm*—Cullen, Sloman, Cantor, Grauer, Scott & Rutherford

[57] ABSTRACT

A tool sharpening fixture for a conventional grinding tool having for example a base mounted on a table, at least a pair of spaced pulleys on the base and a continuous flexible abrasive belt mounted on and around the pulleys, with one of the pulleys being power-driven. The tool-sharpening fixture includes an elongated tool support arm pivotally mounted at one end on the grinding tool having a calibrated protector plate secured to the arm at its pivotal mounting. The arm is releasably retained in a predetermined angular position relative to the grinding tool and a tool anchor plate extends transversely of the arm, slidably mounted thereon for longitudinal adjustment to receive tools of different lengths. An elongated upright platen of arcuate shape and transversely flat is mounted on the grinding tool, which supportably and guidably bears against the interior surface of the belt. The platen preferably being in the form of a French curve substantially and terminating in a straight portion. The platen is vertically adjustable in one embodiment and includes a vertical upright member and a U-shaped platen which is adjustably supported on the upright member.

7 Claims, 8 Drawing Figures

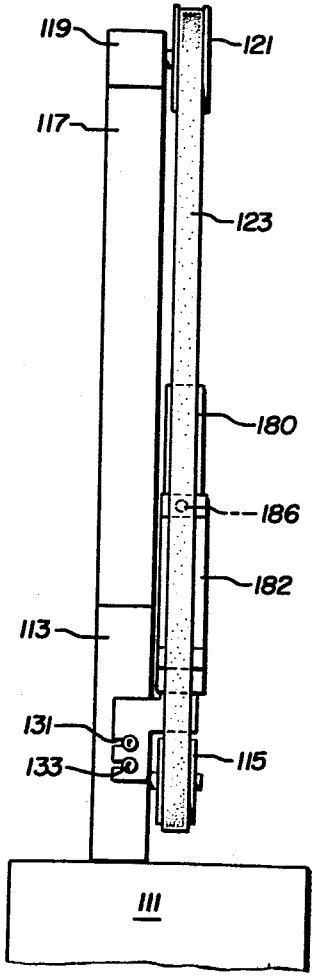
FIG. 7
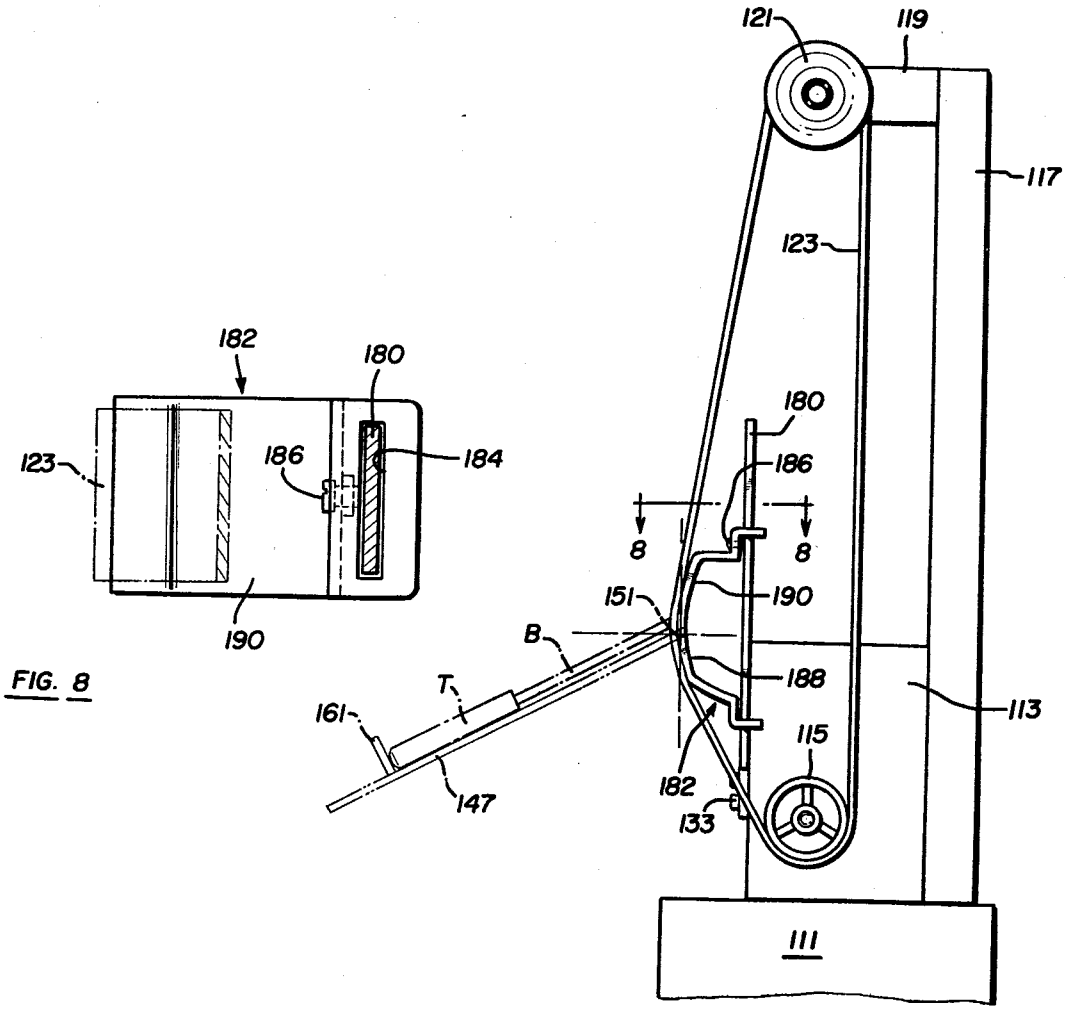
FIG. 6
FIG. 8

TOOL SHARPENING FIXTURE FOR A GRINDING TOOL

RELATED APPLICATION

This application is a continuation in part application of my copending application for U.S. patent, Ser. No. 806,821, filed June 15, 1977, now U.S. Pat. No. 4,091,574 granted May 30, 1978.

BACKGROUND OF THE INVENTION

The present invention relates to a grinding tool fixture for sharpening of wood cutting tools, for example, chisels, gouges, plane irons, scrapers, etc. The fixture is adapted to be mounted on a conventional sander-grinder having a thin belt frictionally driven on pulleys.

Heretofore, there have been provided grinding tools which have a base and which are mounted upon a table and include at least a pair of vertically spaced pulleys with a continuous flexible abrasive belt arranged in an upright plane and mounted around such pulleys, one of said pulleys being power-driven. Heretofore, there has been provided upon the base for the grinding tool an upright platen which is perfectly flat and which is adapted to supportably engage the corresponding interior portion of said flexible abrasive belt over which the belt moves. The tool to be sharpened including its handle was normally manually held by the operator so that the cutting edge thereof engages the continuously moving abrasive belt with the belt being backed up by the corresponding upright platen.

SUMMARY OF THE INVENTION

The invention is directed to a grinding tool having a platen of irregular shape, such as arcuate, as for example, a French curve, and terminating in a straight portion adapted to supportably underly parts of the continuously movable abrasive belt whereby, at the point of application of the blade edge to the belt, the belt takes a shape corresponding to the underlying irregular surface of the platen to thus provide in the ground cutting edge of the tool blade a surface which corresponds to the then adjacent portion of the platen, either flat or arcuate so as to provide flat or hollow ground edge.

The invention also contemplates a tool sharpening fixture which includes an elongated tool support arm which is pivotally mounted at one end upon a suitable support and which includes an anchor plate for supportably receiving and retainingly engaging one end of a tool to be sharpened. The tool including its blade normally extends from the anchor plate in a direction substantially parallel to the pivotal support arm such that the tool engages the abrasive belt substantially tangent to the corresponding surface of the irregular platen upon the underside of said belt supportably and guidably engaging said belt. The anchor plate may be longitudinally adjustable with respect to the arm to accommodate different lengths of tools and the arm itself may be pivotally adjusted with respect to its support to thus present the blade to be ground to the continuously movable abrasive belt at such point relative to the corresponding irregular surface of the platen and similarly deforming the belt at that point for defining in the tool blade a corresponding surface, either flat or undercut.

The preferred embodiment of the present invention includes a vertically adjustable platen comprising an upright member secured to the grinding tool, such as the base and a relatively adjustable platen releasably retained on the upright member. The adjustable platen is preferrably U-shaped having a laterally extending generally U-shaped bite portion and a pair of opposed legs which are slidably received on the upright member. One or both of the legs are releasably retained by a set screw or the like on the upright member and the U-shaped bite portion includes the belt platen as described. The platen portion preferrably includes an arcuate portion which may now be adjusted relative to the pivot axis of the arm to substantially align the pivot axis with the tool engaging tangent to the arc.

The foregoing invention may be better understood by the illustration of a preferred embodiment of the invention, shown in the attached drawing.

THE DRAWINGS

FIG. 6 is a right-side elevation of a second embodiment of the tool sharpening fixture of this invention.

FIG. 7 is a front elevational view of the embodiment of the tool sharpening fixture shown in FIG. 6.

FIG. 8 is a top partial cross-sectional view of the embodiment of the tool sharpening fixture shown in FIG. 6, in the direction of view arrows 8—8.

Figures 1, 2, 3, 4, 5:
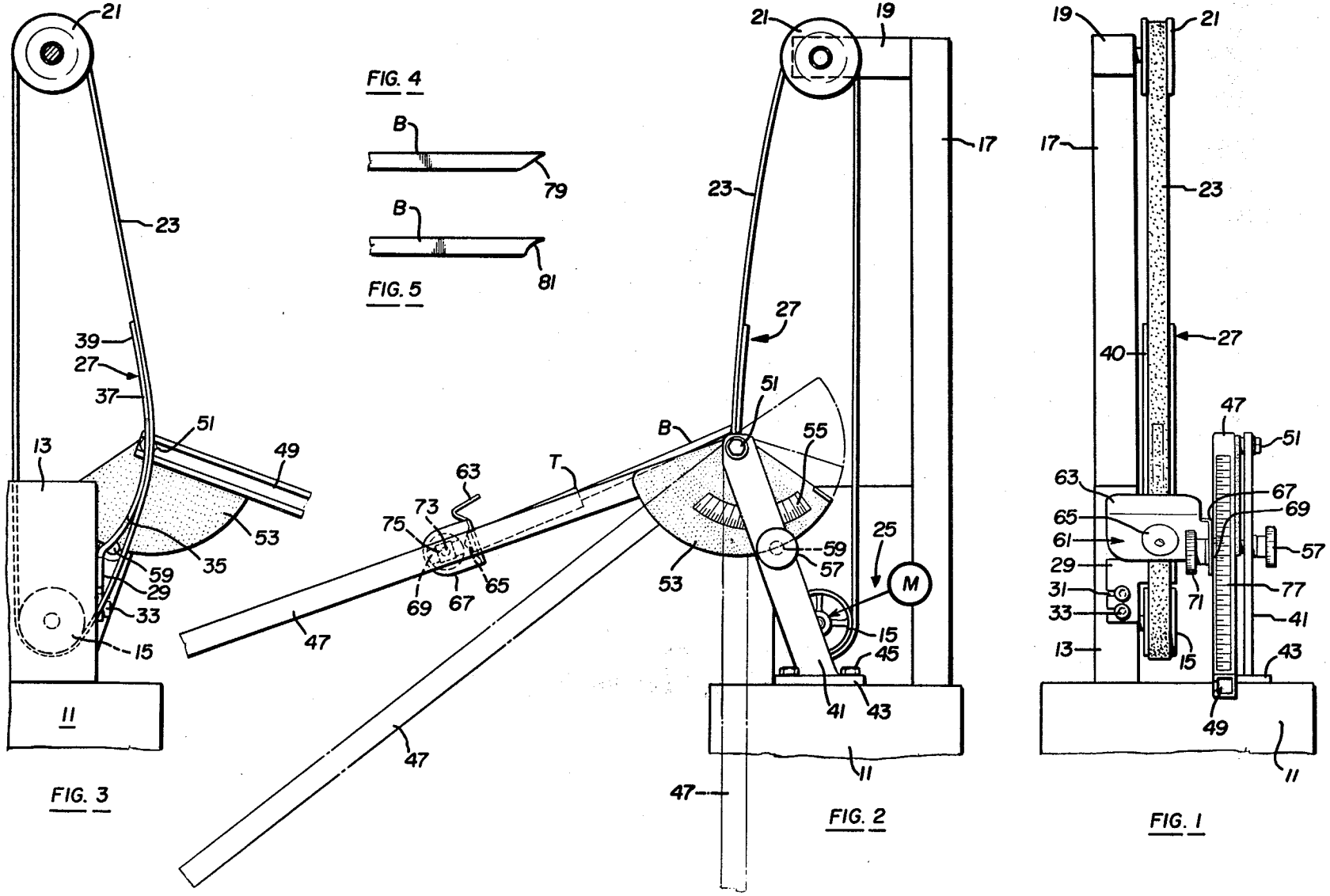
FIG. 1 is a front elevational view of the present tool sharpening fixture for a grinding tool as mounted upon a table, fragmentarily shown.
FIG. 2 is a right-side elevational view thereof.
FIG. 3 is a fragmentary left-side elevational view thereof.
FIG. 4 is a fragmentary side view of a tool blade.
FIG. 5 is a similar view of another tool blade.

It will be understood that the above drawings illustrate merely a preferred embodiment of the invention, and that other embodiments are contemplated within the scope of the claims hereafter set forth.

DETAILED DESCRIPTION OF THE INVENTION

Referring to FIGS. 1 to 5 of the drawings, the present tool sharpening fixture is designed for a grinding tool of conventional construction, which includes an upright base 13 supportably mounted and secured upon table 11, fragmentarily shown. A drive pulley 15 is journalled and supported upon base 13. The base includes an upright 17, FIGS. 1 and 2, which terminates at its upper end in a forwardly extending support arm 19 upon which is journalled and mounted an additional pulley 21.

An elongated generally upright continuous abrasive belt 23 of flexible material extends around and is supported upon the respective pulleys. In the conventional construction of the grinding tool, there is provided a suitable motor schematicly shown at M and having an output which drivingly connects as at 25 the pulley 15 in a conventional manner so as to provide a rotative drive for the continuous abrasive belt.

The irregularly shaped belt support platen 27, FIG. 2, provides a backing for the belt at and along the area where the tool blade is normally applied for sharpening purposes. Said platen at lower end includes the upright mount plate 29 having a pair of laterally extending spaced slots 31 which receive the fasteners 33 for locating and anchoring the mount plate and the platen to base 13 in the manner shown in FIGS. 1 and 3.

The platen adjacent the base plate 29 has an outwardly bowed portion 35 of arcuate shape which merges in an arcuate portion 37 of nonuniform radius so as to define substantially a French curve and which terminates in the substantially flat portion 39 at the upper end of said platen.

Said platen is transversely flat at 40 across its width and is of a width at least as wide and preferably wider than belt 23.

The platen is adjustably mounted by its mounting plate 29 upon the base 13 in such a fashion as to properly center and position the platen so as to lie rearwardly of the belt and to conform the belt substantially to its overall arcuate shape as best shown in FIG. 3.

TOOL BLADE SHARPENING FIXTURE

The fixture is adapted for use in conjunction with the continuously movable grinding belt 23 and includes the upwardly and forwardly inclined leg 41, at its bottom having a mounting plate 43 secured to said table by fasteners 45. Elongated support arm 47 is of tubular form, preferably square in cross section and upon one side has an elongated lateral slot 49.

Pivot bolt 51 extends through leg 41 at its upper end and is secured to support arm 47. The flat protractor 53 with calibrations 55 from 0 to 90 degrees is secured along one edge to the pivot arm 47 and is centered at the pivot bolt 51. The pivot axis of the arm 47 is defined by bolt 51, which is substantially in alignment with platen 27 as shown in FIG. 2. The pivot axis intersects the platen substantially at the transition between the curved and linear portions, 37 and 39 respectively.

The friction wheel 57 is threaded onto a suitable stud which extends from disc 59 on the opposite side of the protractor, said stud being slotted to receive the edges of said protractor. Accordingly, the friction wheel when tightened will draw up the friction disc snugly against the protractor relative to the leg for securing the support arm in any desired angular position, as determined by the protractor calibrations 55.

Tool anchor plate 61 extends laterally at right angles to the support arm 47, includes the forwardly extending top flange 63 and has a cup-shaped depression 65 to receive the end of the handle of the tool T whose blade B is to be sharpened.

Mounting plate 67 extends rearwardly of said anchor plate and includes an elongated rectangular outwardly projected boss 69 which slidably engages within the lateral slot 49 in the support arm 47. The friction wheel 71 includes a bolt 73 which extends through said mounting plate and boss and threadedly engages the nut 75 upon the interior of arm 47 and which spans its lateral slot. Thus, the tool anchor plate may be longitudinally adjusted along the support arm 47 and secured in the desired adjusted position by said friction wheel.

The top surface of the support arm has calibrations thereon at 77 relative to which the tool anchor plate may be moved and thereafter, secured in position by adjusting said friction wheel.

The advantage of the calibrations 77 is that for a particular tool to be sharpened, the anchor plate may be preset at approximately the correct position for receiving the tool with the handle of the tool supportably nested within the cup 65 within the tool anchor plate.

With the present tool sharpening fixture, the tool support arm 47 may be angularly adjusted so as to properly position the forward edge of the blade to be sharpened with respect to the continuously movable flexible abrasive belt 23. At the point where the blade engages the belt, the belt will be formed or deflected to conform to the underlying arcuate shape of the platen 27 so that there is ground within the forward edge of the blade B an undercut or hollow ground edge 81, FIG. 5, corresponding to the then adjacent front surface of the platen.

OPERATION

In operation and during grinding with manual pressure applied to the tool handle and blade with the tool supported by the tool anchor plate, the forward edge of the blade to be ground is so arranged with respect to the moving abrasive belt that its edge being ground is substantially transverse to the adjacent portion of the flexible abrasive belt, which is conforming to the adjacent arcuate surface of the platen. Should it be desired to form a flat edge such as at 79, FIG. 4, on the blade, then the support arm 47 will be angularly adjusted and secured in position so that the tool blade engages the continuously movable abrasive belt at a point which is directly over a straight portion of the platen. The straight portion of the platen conforms the belt to a similar shape to accordingly grind within the tool blade the tapered flat surface such as shown at 79, FIG. 4.

The procedure for sharpening a cutting tool is therefore as follows. First place the tool handle T in the recess 65 in the anchor plate 63. Second, adjust the position of the anchor plate on the arm 47 until the blade tip 13 engages the desired portion of the platen 27. For example, where a hollow grind is desired, the anchor plate is adjusted until the tool edge engages the desired curvature 37. If a straight edge is desired, the tool should engage linear portion 39. Where the tool does not have a handle, such as a plane iron, the blunt end is received in the sharp bend above the cup. Third, adjust the angle of the support arm 47 by loosening pivot bolt 51 and moving the arm until the desired cutting angle is obtained. This angle is checked by sighting the space between the blade edge and the belt 23. The position may be checked with bluing on the blade edge. The position "setting" should now be checked and noted, including the calibrations of the anchor plate and the angle. When the tool is to be resharpened, the setting repeated. The tool is now sharpened by hand biasing the blade against the belt. Where the blade edge is arcuate, the blade is rotated in the cup. The belt may move in either direction around the pulleys.

The pivotal adjustment of the support arm 47 permits the operator to so locate the tool blade edge with respect to the underlying platen surface so as to predetermine the shape of the ground undercut edge or straight edge, as the case may be.

The present tool sharpening fixture is adaptable to any grinding tool whose forward edge is either hollow ground or flat or tapered and may be set up for grinding in a few seconds.

In view of the calibration on the protractor for a particular tool, the arm may be supported in the desired angular position with respect to the support leg 41 so as to assure that the tool blade will be always presented to the belt for a particular tool at the correct angle to, thus, define the cutting edge of the tool as ground either at 79 or 81, FIGS. 4 and 5.

At the same time, tool anchor plate may be longitudinally adjusted and secured in the desired adjusted position along the support arm 47 to accommodate tools and blades of different lengths.

THE ADJUSTABLE PLATEN

As described, the embodiment of the tool sharpening fixture of FIGS. 6 to 8 includes a vertically adjustable platen, permitting accurate alignment between the platen and the tool. The grinding tool may be of similar construction to the tool described in regard to FIGS. 1 to 5, including a table or base 111, an upright base 113, a drive pulley 115 and a driven pulley 121 supported on upright 117 and support arm 119 as described above. A flexible abrasive belt 123 extends around and is supported upon the respective pulleys. The details of the construction will not be described herein, but reference may be made to the above description. The elements of the grinding tool are thus numbered in sequence with the above description.

The platen in this embodiment includes a generally flat upright member or plate 180 which is secured to the upright base 113 by fasteners 133. As described above in regard to the single piece platen, the upright member includes a pair of laterally extending spaced slots 131 which receive the fasteners to retain the upright member. The upright member 180 in the disclosed embodiment is generally L-shaped having an elongated upright portion and a transverse leg including the slots 131. The upright member may thus be similar to the platens presently supplied on grinding tools of the type disclosed.

In the prefered embodiment of this invention, a vertically adjustable platen 182 is releasibly supported on the upright member 180. The adjustable platen is generally U or C-shaped and includes a C-shaped bite portion and a pair of opposed legs having aligned slots 184, FIG. 8, which receives the upright member 180. In the disclosed embodiment, the platen is releasibly retained on the upright member by a set screw 186 as best shown in FIGS. 6 and 8. The grinding belt 123 is thus supported by the C-shaped bite portion of the adjustable platen which preferably includes an arcuate portion 188 which blends into a relatively straight portion 190 extending tangentially to the arcuate portion.

The adjustable platen has several important advantages over the single piece platen described above in regard to FIGS. 1 to 3. First, the platen may be adjusted vertically to align the pivot 151 of the support arm shown in phantom at 147. Thus the platen may be vertically adjusted such that the pivot axis 151 intersects the platen at or adjacent the desired curvature for the tool blade end. Second, the adjustable platen may be easily removed or installed on a conventional grinding tool platen which is generally similar to the upright member 180. Finally, the adjustable platen is less expensive than the single piece platen 80 described above.

It will be understood that the details of the grinding tool fixture of FIGS. 6 to 8 may be similar to the fixture described in regard to FIGS. 1 to 3. The support arm 147 may be pivotally supported on the fixture as described and a protractor may be provided for angular adjustment of the arm, if desired. The arm may be pivotally supported on a bracket assembly as described above or attached directly to the upright base 113 by a suitable fixture or bracket.

Having described my invention, it will be understood that various modifications may be made to the tool sharpening fixture of this invention and particularly the grinding tool described. For example, the various structural elements may be formed from angle or tubular stock. The arm 47, 147 may be extensible by using telescopically adjustable sections or tubular stock and the upright 41 may be adjustable by using telescopic sections or securing the bolts in longitudinal slots. Reference may now be made to the following claims.

I claim:

1. A tool sharpening fixture for a grinding tool having at least a pair of spaced pulleys, a continuous flexible abrasive belt mounted around said pulleys with one of said pulleys being power driven, the fixture comprising a generally upright platen member retained adjacent one run of said continuous belt and a U-shaped platen releasably retained on said upright member having a laterally extending C-shaped bite portion supportably and guidably bearing against the interior surface of said belt, said U-shaped platen having a pair of opposed spaced legs, each having an elongated slot receiving said upright member, at least one of said legs including means releasably retaining said platen on said upright member, an elongated support arm pivotally supported on said grinding tool, angularly and adjustably mounted on said grinding tool, and support means slidably mounted on said arm for retaining a tool having a blade in bearing contact with said belt.

2. The tool sharpening fixture defined in claim 1, characterized in that said arm is pivotally supported on said grinding tool with the pivot axis perpendicular to the C-shaped bite portion of said platen, such that the platen may be vertically adjusted on said upright member to align said arm pivot axis with the desired portion of said C-shaped bite portion of said platen.

3. The tool sharpening fixture defined in claim 2, characterized in that said C-shaped portion of said platen includes a portion of changing curvature, such that said platen may be adjusted relative to the pivot axis of said arm to align said pivot axis with the desired curvature on said platen.

4. The tool sharpening fixture of claim 2, characterized in that said C-shaped platen portion includes a lower curved portion of changing curvature and an upper portion extending generally tangentially to the adjacent curved portion.

5. A tool sharpening fixture for a grinding tool having a continuous abrasive belt, said fixture having a tool support arm pivotally supported on said fixture about a pivot axis, said arm including a tool support means, a platen assembly comprising an upright member attachable to said grinding tool and a generally U-shaped platen releasably retained on said upright member having a convex face supportably and guidably bearing against the interior surface of said abrasive belt, said pivot axis being in general alignment with the platen face, said platen being additionally vertically adjustable on said upright member to align a predetermined portion of said platen with the blade of a tool received on said tool support means adjacent the pivot axis of said support arm.

6. The tool sharpening fixture defined in claim 5, characterized in that said U-shaped platen includes an arcuate portion of changing curvature and a tangentially extending relatively straight portion, said curved and straight portions extending laterally and bearingly supporting said belt upon engagement by a tool blade.

7. A tool sharpening fixture for a grinding tool having a continuous flexible abrasive belt mounted around pulleys, the fixture comprising a generally upright platen member retained adjacent one run of said continuous belt and a U-shaped platen releasably retained on said upright member having a laterally extending C-shaped bite portion supportably and guidably bearing against the interior surface of said belt, said U-shaped platen in the form of a continuous strip having a pair of arms extending from opposed ends of said C-shaped bite portion generally transverse to said upright platen member, said arms each having a slot, said slots being vertically aligned and slidably receiving said upright platen member for adjustment of said U-shaped platen on said upright member and a releasable fastener retaining said U-shaped platen on said upright member in a desired position, an elongated arm pivotally supported on said tool, angularly adjustable about said pivotal support and means on said arm for retaining a tool having a blade in bearing contact with said belt.

* * * * *